US010081112B2

(12) United States Patent
Langenwalter et al.

(10) Patent No.: US 10,081,112 B2
(45) Date of Patent: Sep. 25, 2018

(54) KNIFE WITH REMOVABLE SCALES AND BOTTLE OPENER

(71) Applicant: Fiskars Brands, Inc., Madison, WI (US)

(72) Inventors: Keith Langenwalter, Ridgefield, WA (US); Jason Keenan, Lake Oswego, OR (US)

(73) Assignee: Fiskars Brands, Inc., Middleton, WI (US)

( * ) Notice: Subject to any disclaimer, the term of this patent is extended or adjusted under 35 U.S.C. 154(b) by 458 days.

(21) Appl. No.: 14/612,078

(22) Filed: Feb. 2, 2015

(65) Prior Publication Data

US 2015/0217461 A1 Aug. 6, 2015

Related U.S. Application Data

(60) Provisional application No. 61/935,086, filed on Feb. 3, 2014.

(51) Int. Cl.

| | |
|---|---|
| ***B26B 11/00*** | (2006.01) |
| *B28B 11/00* | (2006.01) |
| *B67B 7/16* | (2006.01) |
| *B26B 1/04* | (2006.01) |

(52) U.S. Cl.
CPC ..... *B26B 11/00* (2013.01); *B26B 1/042* (2013.01); *B26B 1/04* (2013.01); *B26B 11/003* (2013.01); *B26B 11/006* (2013.01); *B28B 11/001* (2013.01); *B67B 7/16* (2013.01)

(58) Field of Classification Search
CPC ..... B26B 11/00; B26B 1/04; B26B 1/042; B26B 11/001; B26B 11/003; B26B 11/006; B67B 7/16
USPC ..... 7/128, 118, 151; 30/155
See application file for complete search history.

(56) References Cited

U.S. PATENT DOCUMENTS

| | | | | |
|---|---|---|---|---|
| 4,730,393 A | | 3/1988 | Coburn | |
| 4,918,775 A | | 4/1990 | Leu | |
| 5,103,520 A | | 4/1992 | Mazzo | |
| 5,283,920 A | * | 2/1994 | Plummer | A01K 97/00 43/4 |
| 5,320,004 A | | 6/1994 | Hsiao | |
| 5,331,741 A | * | 7/1994 | Taylor, Jr. | B26B 1/02 30/158 |

(Continued)

FOREIGN PATENT DOCUMENTS

| | | |
|---|---|---|
| CN | 1162516 C | 10/1997 |
| CN | 201086296 Y | 7/2008 |

(Continued)

OTHER PUBLICATIONS www.bespokepost.com.*
International Search Report and Written Opinion for Application PCT/US2015/014126, dated May 8, 2015, 13 pages.

*Primary Examiner* — Monica Carter
*Assistant Examiner* — Katina Henson
(74) *Attorney, Agent, or Firm* — Foley & Lardner LLP

(57) ABSTRACT

A knife includes a knife body having two liners and a blade positioned between the two liners. The knife further includes two scales, each scale being removably coupled to one of the two liners. Each scale is configured for use as a tool separate from the knife body when removed from the knife body. A bottle opener may be formed in the knife body.

19 Claims, 4 Drawing Sheets

(56) References Cited

U.S. PATENT DOCUMENTS 5,511,310 A * 4/1996 Sessions ..... B26B 1/042 30/155
5,531,365 A 7/1996 Donnelly
5,605,495 A * 2/1997 Jenkins, Jr. ..... B24D 15/084 30/138
5,689,885 A * 11/1997 Walston ..... B26B 1/04 30/160
5,829,965 A 11/1998 Rubalcava
5,857,268 A 1/1999 Park
5,887,347 A * 3/1999 Gibbs ..... B26B 1/042 30/155
5,890,294 A 4/1999 Keklak et al.
6,125,489 A 10/2000 Zeller et al.
6,314,600 B1 11/2001 Cachot
D452,037 S 12/2001 Smith
6,481,034 B2 11/2002 Elsener et al.
7,055,200 B2 6/2006 Lion et al.
7,063,435 B2 6/2006 Dallas et al.
7,195,371 B2 3/2007 Thuma et al.
7,647,701 B1 * 1/2010 Mollick ..... B26B 1/04 30/155
7,793,570 B2 9/2010 Mattson et al.
7,997,170 B1 8/2011 Martinez et al.
8,015,642 B1 9/2011 Oakley
8,109,002 B2 2/2012 Frazer
8,707,490 B1 * 4/2014 Pelton ..... B26B 1/00 30/123
9,003,585 B2 4/2015 Salin et al.
9,387,595 B2 * 7/2016 Ikoma ..... B26B 1/042
2002/0029426 A1 3/2002 Seber et al.
2003/0074739 A1 4/2003 Seber et al.
2003/0079295 A1 5/2003 Ho
2004/0016058 A1 1/2004 Gardiner et al.
2004/0255388 A1 12/2004 Lion et al.
2004/0255389 A1 12/2004 Seber et al.
2005/0105286 A1 5/2005 Dallas et al.
2005/0174764 A1 8/2005 Thuma et al.
2005/0183552 A1 * 8/2005 Hawkins ..... B25B 13/56 81/440
2005/0241154 A1 * 11/2005 Lake ..... B26B 1/042 30/160
2006/0075570 A1 4/2006 Gelfand
2006/0207112 A1 9/2006 Dunn et al.
2006/0277762 A1 * 12/2006 Knight ..... B26B 1/02 30/153
2007/0169351 A1 * 7/2007 Steigerwalt ..... B26B 1/042 30/155
2008/0256718 A1 10/2008 Mattson et al.
2009/0172889 A1 7/2009 Votolato
2010/0218382 A1 9/2010 Scott
2012/0017442 A1 * 1/2012 King ..... B26B 1/02 30/155
2012/0102756 A1 5/2012 Garavaglia et al.
2012/0240419 A1 9/2012 Wagner
2013/0097786 A1 4/2013 Hardinge et al.
2013/0139324 A1 6/2013 Pelton
2013/0160213 A1 6/2013 Salles
2013/0192004 A1 8/2013 Salin et al.
2013/0283539 A1 10/2013 Suhami

FOREIGN PATENT DOCUMENTS

CN 202016055 U 10/2011
FR 2760955 A1 9/1998
JP 11-047459 A 2/1999
JP 2004-237040 A 8/2004
WO WO-86/04010 A1 7/1986

* cited by examiner

KNIFE WITH REMOVABLE SCALES AND BOTTLE OPENER

This application claims the benefit of U.S. Provisional Application No. 61/935,086, filed Feb. 3, 2014, which is incorporated herein by reference in its entirety.

BACKGROUND

Bicyclists may carry tools to make various repairs to the bicycle when riding. A common issue is a flat tire, which may require the use of tire levers to remove the tire from the rim and access the inner tube to repair a leak or replace the inner tube. Bicyclists also may carry small pocket knives to be used as general purpose tools to fix various problems which require cutting, prying, and twisting. For example, a knife may be used to remove an object that is embedded in the tire.

Bottle openers have been added to knives in the past, but the bottle opener has typically been provided as a notched handle, as a separate component that folds out of the handle, or as a notched blade. In knives including a notched handle intended to act as a bottle opener, the comfort and safety of the grip on the knife may be compromised. In knives including a bottle opener as a separate component, the bottle opener must be opened before use, such as by unfolding the bottle opener from the handle. This requires additional time and movement before the bottle opener may be used, which may compromise the convenience of the bottle opener. In knives including a notched blade intended to act as a bottle opener, the strength of the blade may be compromised.

SUMMARY

One embodiment of the invention relates to a knife including a knife body and two scales. The knife body includes two liners and a blade positioned between the two liners. The blade may be rotatably coupled to the two liners proximate a first end of the two liners. A lock back catch may be positioned between the two liners, and a spring spacer may be positioned between the two liners proximate a second end of the two liners. Each scale is removably coupled to one of the two liners. Each scale is configured for use as a tool separate from the knife body when removed from the knife body. A bottle opener may be formed in the knife body. The bottle opener may be formed by the combination of the lock back catch and the spring spacer.

Another embodiment of the invention relates to a knife including two liners, a blade positioned between the two liners and rotatably coupled to the two liners proximate a first end of the two liners, a lock back catch positioned between the two liners, and a spring spacer positioned between the two liners proximate a second end of the two liners. A bottle opener is formed by the lock back catch and the spring spacer.

Another embodiment of the invention relates to a knife including a knife body and two scales. The knife body includes two liners and a blade positioned between the two liners and rotatably coupled to the two liners proximate a first end of the two liners. Each scale is removably coupled to one of the two liners. Each scale is configured for use as a tool separate from the knife body when removed from the knife body.

Alternative exemplary embodiments relate to other features and combinations of features as may be generally recited in the claims.

BRIEF DESCRIPTION

The invention will become more fully understood from the following detailed description, taken in conjunction with the accompanying drawings, wherein like reference numerals refer to like elements.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
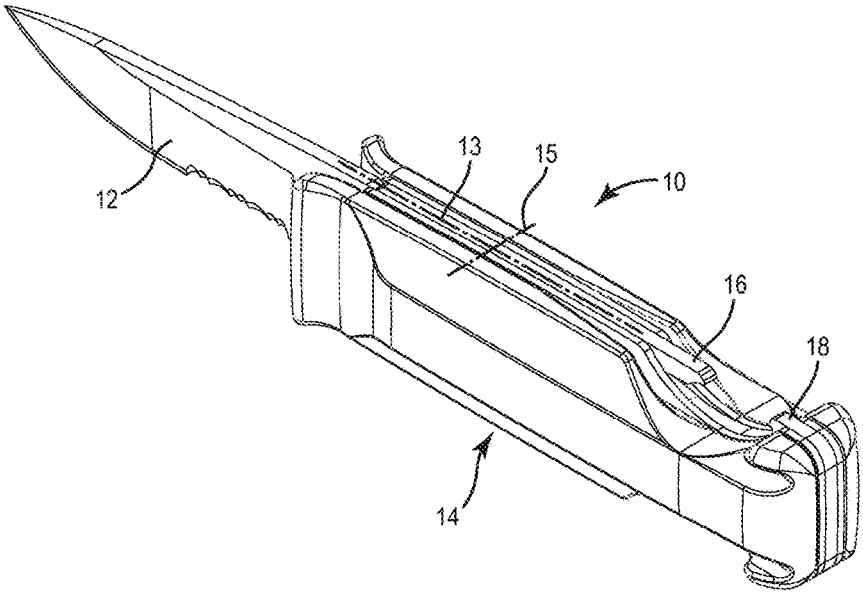
FIG. 1 is a perspective view of a knife in an open configuration, according to an exemplary embodiment.
Figure 2:
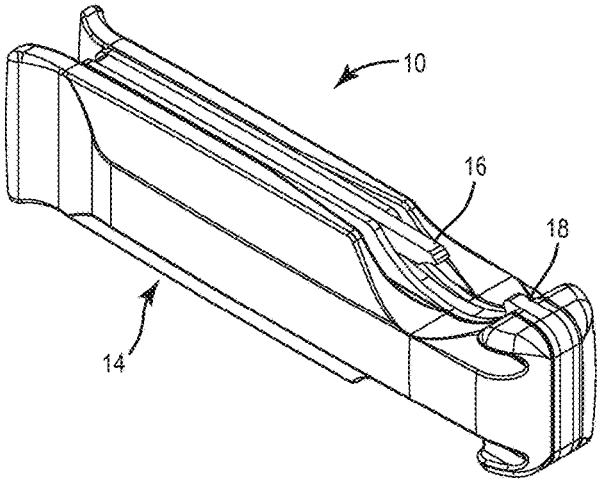
FIG. 2 is a perspective view of the knife of FIG. 1 in a closed configuration.

Referring in general to FIGS. 1-7, a knife 10 is shown according to an exemplary embodiment to include a blade 12 that is rotatably coupled to a handle 14. The blade 12 can be rotated relative to the handle 14 from an open configuration (FIG. 1) to a closed configuration (FIG. 2). In the open configuration, the blade 12 is locked into a position extending away from the handle 14 with a liner lock feature through the interaction of the blade 12 with a lock back catch 16 and a spring spacer 18. In the closed configuration, the blade 12 is folded into the handle 14 such that the sharp edge of the blade 12 is concealed within the handle 14. A longitudinal axis 13 extends along the length of the knife and a transverse, lateral axis 15 extends orthogonally to the longitudinal axis 13. In alternative embodiments, the knife may be a fixed blade knife with the blade non-rotatably coupled to the handle in one of various configurations known in the art.

The knife 10 is configured to include additional tools, such as a tire lever or a bottle opener. The additional tools are integrally formed with components of the knife 10 and are configured to not interfere with the normal use of the blade 12. By integrating tools such as a tire lever or a bottle opener into the existing components of the knife 10, the knife 10 can provide the functionality of multiple tools without the additional space and weight requirements needed for multiple, separate tools.

Figure 3:
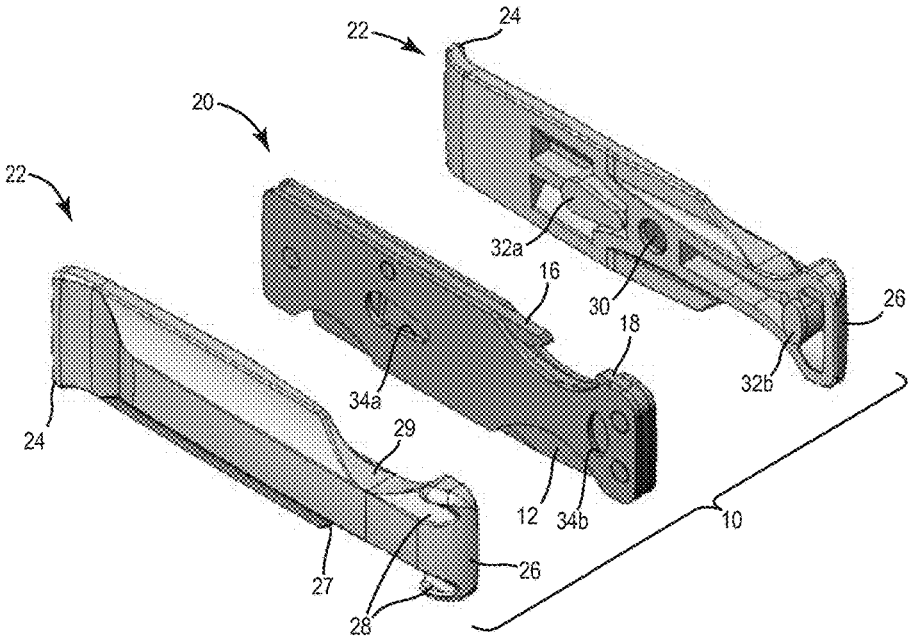
FIG. 3 is an exploded view of the knife of FIG. 1.

Referring to FIG. 3, an exploded view of the knife 10 is shown, with the blade 12 folded into the handle 14 in the closed position. The handle 14 includes a central, inner portion 20 and outer portions or scales 22 that are removably coupled to the inner portion 20. The inner portion 20 and the blade 12 together form a knife body. The scales 22 are configured to be usable as tire levers to separate the beads of a bicycle tire from the wheel rim in order to remove the tire from the rim. The scales 22 include a first end 24 configured to engage the tire bead and a second end 26 configured to engage a spoke of the wheel. According to an exemplary embodiment, the first end 24 is a tapered body that curves slightly outward. The shape of the first end 24 facilitates the insertion of the first end 24 between the rim and the bead.

The second end 26 includes one or more grooves 28 configured to receive the wheel spoke. Cutouts 27 and 29 are formed in the scale proximate to the second end 26. The cutouts 27 and 29 extend inward from the bottom and top sides of the scale 22, respectively, to provide passages through which the wheel spokes may pass from the back of the scale 22 to the front of the scale 22.

A user may insert the first end 24 of one of the scales 22 between the bead and the rim, hook the bead with the first end 24, pivot the scale 22 on the rim, pass a wheel spoke through the cutout 27 or 29, and then hook the spoke with the second end 26 to keep the bead of the tire separated from the rim. The process may be then repeated with the second scale 22 a short distance away from the first scale 22. The user may work the scales 22 around the circumference of the wheel, repeating the process to remove the tire.

According to an exemplary embodiment, the scales 22 are magnetically coupled to the inner portion 20, allowing for the easy removal of the scales 22 from the inner portion 20 by the user. In one embodiment, the inner portion 20 is formed of a ferromagnetic metal or alloy, such as steel. The scales 22 each include an embedded magnet 30. The scales 22 may be formed of a metal or alloy or of a non-ferromagnetic material, such as a polymer. In another embodiment, either the inner portion 20 and/or the scales 22 may be magnetized and may be magnetically coupled to the other component without an embedded magnet. In another embodiment, both the inner portion 20 and the scales 22 may be formed from non-ferromagnetic materials and the magnetic coupling may be achieved via magnets and ferromagnetic metals or alloys embedded in the non-ferromagnetic materials.

Rotation between the inner portion 20 and the scales 22 is limited by the engagement of protrusions 32*a* and 32*b* (e.g., bosses, tabs, projections, etc.) and corresponding recesses 34*a* and 34*b* (e.g., hollows, apertures, etc.). According to an exemplary embodiment, the scales 22 include a first inwardly extending protrusion 32*a* proximate the middle of the scale and a second inwardly extending protrusion 32*b* proximate the second end 26. Either side of the inner portion 20 includes a first recess 34*a* and a second recess 34*b* that are sized and shaped to receive the protrusions 32*a* and 32*b*. In other embodiments, the protrusions and the corresponding recesses may be otherwise shaped. For example, the protrusions may be generally cylindrical pegs, rectangular bosses, etc. In other embodiments, the positions of the protrusions and the recesses may be reversed, with protrusions extending outward from the inner portion 20 to be received in recesses formed in the scales 22.

Figure 4:
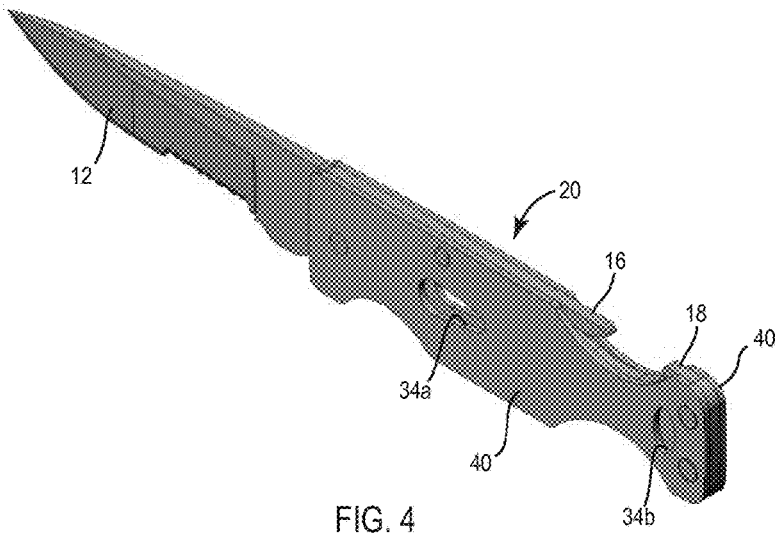
FIG. 4 is a perspective view of a central portion of the knife of FIG. 1 with the scales removed.

Referring now to FIG. 4, the inner portion 20 of the knife 10 is shown. The inner portion 20 includes a pair of liners 40 (e.g., walls, body members, frame members, etc.) surrounding the blade 12, the lock back catch 16, and the spring spacer 18. The knife body formed by the inner portion 20 and the blade 12 may be used independently of the scales 22, with the blade 12 being lockable in the open position and being able to be folded into and concealed between the liners 40 in the closed position.

Figure 5:
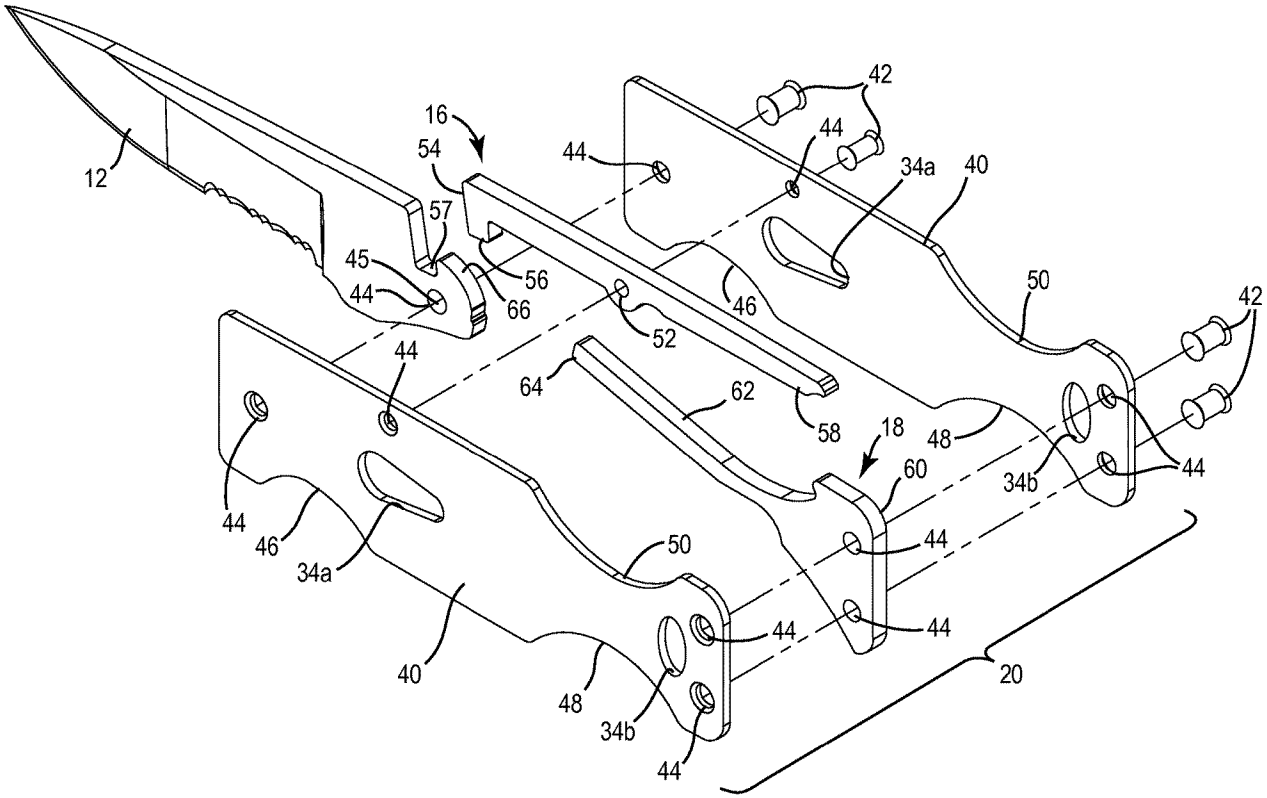
FIG. 5 is an exploded view of the central portion of the knife of FIG. 1.

Referring to FIG. 5, an exploded view of the inner portion 20 is shown. The liners 40 are coupled together with mechanical fasteners such as rivets 42 passing through apertures 44 in the liners 40, the blade 12, the lock back catch 16, and the spring spacer 18. One of the rivets 42 passes through the blade 12 and provides a pivot point 45 about which the blade 12 can rotate between the open position and the closed position relative to the liners 40. In one embodiment, the recesses 34*a* and 34*b* are through-holes. In other embodiments, the recesses 34*a* and 34*b* may be depressions in the surface of the liners 40 that are deep enough to receive the protrusions 32*a* and 32*b* of the scales 22. According to an exemplary embodiment, the liners 40 are formed of a ferromagnetic metal or alloy such as steel, allowing the scales 22 to be magnetically coupled to the liners 40 via the embedded magnets 30.

The liners 40 include a multitude of cutouts that provide various functionality for the knife 10, both when the scales 22 are coupled to the inner portion 20 and when the scales 22 are removed from the inner portion 20. A first cutout 46 proximate to the lower front portion of the knife 10 provides a contour for receiving a portion of the user's hand (e.g., the index finger) when the inner portion 20 is used independently of the scales 22. A second cutout 48 proximate to the lower rear portion of the knife 10 provides access to the blade 12 when the blade 12 is in the folded position. The second cutout 48 may be aligned with the cutout 27 in the scale 22 when the scale 22 is coupled to the inner portion 20. A user may grasp the blade 12 through the second cutout 48 to rotate the blade from the closed position to the open position, as shown in FIGS. 2 and 4. A third cutout 50 proximate to the upper rear portion of the knife 10 provides access to the lock back catch 16, allowing the user to unlock the blade 12 from the unfolded position. The third cutout 50 may be aligned with the cutout 29 in the scale 22 when the scale 22 is coupled to the inner portion 20.

The lock back catch 16 is a lever that engages the blade 12 to lock the blade 12 in the unfolded position. The lock back catch 16 is coupled to the liners 40 at a pivot point 52 provided by a rivet 42 passing through the liners 40 and through the lock back catch 16. A forward end 54 of the lock back catch 16 includes a head 56 that is received in a corresponding notch 57 in the blade 12. The rearward end 58 of the lock back catch 16 extends into the third cutout 50. By pressing down on the rearward end 58, a user can rotate the lock back catch 16 about the pivot point 52.

The spring spacer 18 includes a base 60 that is coupled between the liners 40 at the rear portion of the knife 10 (e.g., with rivets 42) and a spring arm 62 extending forward from the base 60. The distal end 64 of the spring arm 62 contacts the lock back catch 16 between the pivot point 52 and the rearward end 58. The spring arm 62 further serves as a guard, preventing contact with the sharp edge of the blade 12 through the third cutout 50 when the blade 12 is in the closed position.

Figure 6:
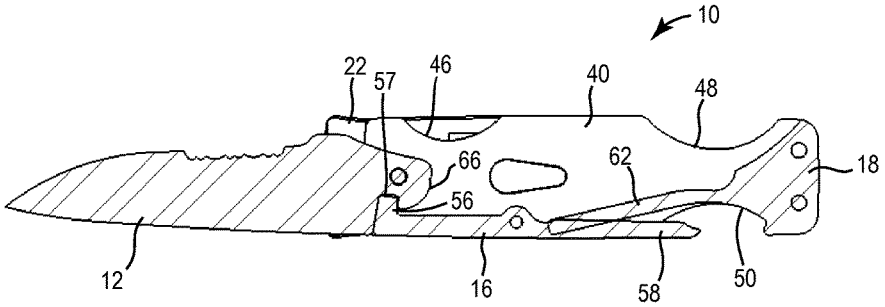
FIG. 6 is cross-section view of the knife of FIG. 1.

From the closed position, a user may grasp the back edge of the blade 12 through the second cutout 48. As the blade 12 is rotated about the pivot point 45, the head 56 of the lock back catch 16 rides along a curved contact surface 66 of the blade 12. Referring to FIG. 6, when the blade 12 is in the open position, the head 56 is forced into the notch 57 by the biasing force of the spring arm 62. With the head 56 received in the notch 57, the rotational movement of the blade 12 is restricted. In this way, the knife 10 can be safely rigidly or fixedly secured in the open position for use by the user. In order to close the blade 12, the user must press in on the rearward end 58 of the lock back catch 16 with a force sufficient to overcome the biasing force of the spring arm 62 to disengage the head 56 from the notch 57 in the blade 12. The blade 12 may then be rotated back to the closed position.

Figure 7:
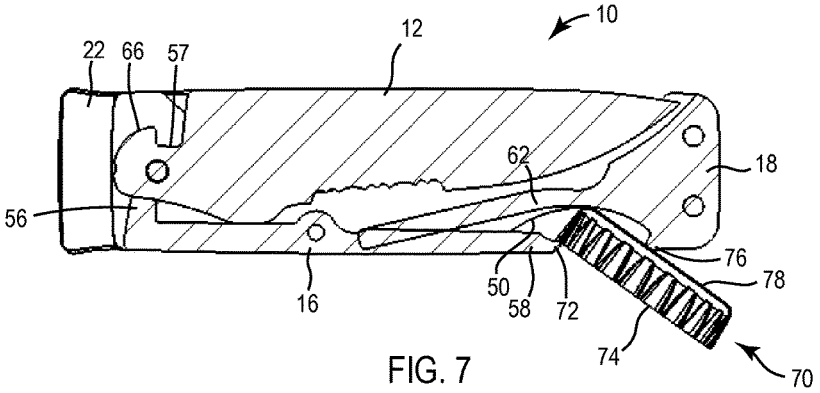
FIG. 7 is a cross-section view of the knife of FIG. 2, showing a bottle opener feature in use.

Referring now to FIG. 7, the knife 10 is shown engaging a bottle cap 70 with a bottle opener feature provided in the third cutout 50. The rearward end 58 of the lock back catch 16 includes a hook 72 that is configured to engage the lip 74 of the bottle cap 70 when the bottle cap 70 is inserted into the third cutout 50. The base 60 of the spring spacer 18 includes a protrusion 76. The top surface 78 of the bottle cap 70 contacts the protrusion 76 when the bottle cap 70 is inserted into the third cutout 50 to provide a rotation point, about which the knife 10 may be rotated. In other embodiments, the rotation point can be provided by another component of the knife 10, such as by one or both of the scales 22 of by one or both of the liners 40. In embodiments where the knife is a fixed blade knife, the lock back catch 16 and spring spacer 18 would not be necessary to provide the functions associated with locking and unlocking a rotatable blade into the open position, but similar components may still be included having structural features similar to the hook 72 and protrusion 76 in order to provide for the bottle cap removing function.

To use the bottle opener feature, a user inserts the bottle cap 70 into the third cutout 50 and hooks the lip 74 of the bottle cap 70 with the hook 72. The knife 10 may then be rotated upward about the rotation point between the protrusion 76 and the top surface 78 of the bottle cap 70 to lift off or peel the lip 74 of the bottle cap 70 away from the rim of a bottle.

The bottle opener feature can be used with the blade 12 in the closed position with the sharpened edge concealed within the handle 14. The bottle opener feature (e.g., the lock back catch 16 and the spring spacer 18) is recessed into the handle 14 and below the surface of the scales 22. That is, the bottle opener feature does not extend outward along the lateral axis 15 to interrupt the smooth outermost contour of the scales 22. The handle 14 therefore lacks protruding components related to the bottle opener feature and the comfort of the handle 14 is maintained. The bottle opener feature is available at all times and does not require any component to be folded out of the handle 14 to use. The bottle opener feature does not include altering the blade 12, maintaining the strength of the blade 12.

While the integrated tools are described as tire levers and a bottle opener, the knife 10 may be configured to include a wide variety of tools. For example, the removable scales 22 may be configured as one or more camping tools, such as a solar charger, a scraper/squeegee, an eating utensil (e.g., spork, knife, fork, spoon, etc.), a dispenser (e.g., insect repellant dispenser, sun block dispenser, etc.), a floatation device, or a storage compartment for a fishing kit. In other embodiments, the removable scales 22 may be configured as one or more everyday carry tools, such as a clock, a microflask, a tweezer, a tooth pick, lip balm, a key holder, a key (e.g., for a bike lock), a key fob, scissors, a cell phone attachment, a zip cord/lanyard, a writing implement, a USB storage drive, or a money clip. In other embodiments, the removable scales 22 may be configured as one or more industrial tools, such as a level, a screw driver, a bit driver, a storage compartment for screw driver bits, a circuit tester, TSA compliant solid state tools, a wire stripper, or a prybar. In other embodiments, the removable scales 22 may be configured as storage for medicine, a first aid kit, or a medical ID. In other embodiments, the removable scales 22 may be configured as one or more survival tools, such as a compass, a hand warmer, a magnifying glass, an antenna, a water filter, a straw, a sharpener, a signaling mirror, a personal locater beacon, a whistle, an edible substance, a light/illumination device, a fire starter, a lighter, or a reflector. In other embodiments, the removable scales 22 may be configured as one or more other tools, such as a storage compartment for food, a fan, a credit card reader, a compartment for hand sanitizer, a laser pointer, a camera, a shoe horn, a personal breathalyzer, a handle extender, a cord carrier, an attachment for connecting the knife 10 to a webbing system (e.g., a Molle attachment), or a tire pressure gauge. In some embodiments, the two scales 22 may be configured to be combined to form a tool (e.g., are coupled together to form a tool). In some embodiments, the scale 22 may be configured with a pocket clip or include a pocket clip in addition to another tool, allowing the user to clip the scale 22 or the knife 10 to which the scale 22 is attached to a pocket, belt or other article. In some embodiments, the scale 22 including the pocket clip is permanently secured to the inner portion 20 of the handle 14 with the other scale 22 removable by the user for use as a separate tool.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

The construction and arrangement of the elements of the mounting system as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The scales may be otherwise removably coupled to the inner portion of the handle, such as with a non-ferromagnetic, purely mechanical mechanism. Some like components have been described in the present disclosure using the same reference numerals in different figures. This should not be construed as an implication that these components are identical in all embodiments; various modifications may be made in various different embodiments. It should be noted that the elements and/or assemblies of the enclosure may be constructed from any of a wide variety of materials that provide sufficient strength or durability, in any of a wide variety of colors, textures, and combinations. Furthermore, other substitutions, modifications, changes, and omissions may be made in the design, operating conditions, and arrangements of the exemplary embodiments without departing from the scope of the invention as expressed in the appended claims.

What is claimed is:

1. A knife, comprising:

a knife body, comprising:

two liners;

a blade positioned between the two liners;

two scales, each scale removably coupled to one of the two liners;

wherein each scale is also a tool usable separate from the knife body when removed from the knife body;

wherein a bottle opener is formed in the knife body;

wherein the blade is rotatably coupled to the two liners proximate a first end of each of the two liners, and the bottle opener is formed from a lock back catch and a spring spacer positioned between the two liners;

wherein each liner includes a cutout proximate a second end of the liner, wherein a hook of the lock back catch is accessible via the cutouts, wherein a protrusion of the spring spacer is accessible via the cutouts; and wherein the hook and the protrusion are arranged so that the bottle opener operates with the hook engaged with a lip of a bottle cap and with the protrusion in contact with a top surface of the bottle cap as a rotation point, so that rotation of the knife removes the bottle cap from a bottle.

2. The knife of claim 1, wherein the tool is a tire lever.

3. The knife of claim 1, wherein each scale is magnetically coupled to one of the two liners.

4. The knife of claim 1, wherein at least one of the scales includes a pocket clip.

5. A knife, comprising:

two liners;

a blade positioned between the two liners and rotatably coupled to the two liners proximate a first end of each of the two liners;

a lock back catch positioned between the two liners; and a spring spacer positioned between the two liners proximate a second end of each of the two liners;

wherein a bottle opener is formed by the lock back catch and the spring spacer.

6. The knife of claim 5, wherein the lock back catch includes a hook and the spring spacer includes a protrusion, wherein the hook and the protrusion are arranged so that the bottle opener operates with the hook engaged with a lip of a bottle cap and with the protrusion in contact with a top surface of the bottle cap as a rotation point, so that rotation of the knife removes the bottle cap from a bottle.

7. A knife, comprising:

a knife body, comprising:

two liners; and a blade positioned between the two liners and rotatably coupled to the two liners proximate a first end of each of the two liners; and two scales, each scale removably coupled to one of the two liners;

wherein each scale is also a tool usable separate from the knife body when removed from the knife body.

8. The knife of claim 7, wherein the tool is a tire lever.

9. The knife of claim 7, wherein each scale is magnetically coupled to one of the two liners.

10. The knife of claim 9, wherein each scale includes a magnet and at least a portion of each liner is ferromagnetic.

11. The knife of claim 9, wherein each liner includes a magnet and at least a portion of each scale is ferromagnetic.

12. The knife of claim 7, wherein each scale includes a protrusion and each liner includes a corresponding recess, wherein each protrusion is received by the corresponding recess when the scale is coupled to the liner.

13. The knife of claim 7, wherein each liner includes a protrusion and each scale includes a corresponding recess, wherein each protrusion is received by the corresponding recess when the scale is coupled to the liner.

14. The knife of claim 7, wherein at least one of the scales includes a pocket clip.

15. The knife of claim 3, wherein each scale includes a magnet and at least a portion of each liner is ferromagnetic.

16. The knife of claim 3, wherein each liner includes a magnet and at least a portion of each scale is ferromagnetic.

17. The knife of claim 1, wherein each scale includes a protrusion and each liner includes a corresponding recess, wherein each protrusion is received by the corresponding recess when the scale is coupled to the liner.

18. The knife of claim 1, wherein each liner includes a protrusion and each scale includes a corresponding recess, wherein each protrusion is received by the corresponding recess when the scale is coupled to the liner.

19. The knife of claim 7, further comprising:

a lock back catch positioned between the two liners; and a spring spacer positioned between the two liners proximate a second end of each of the two liners;

wherein a bottle opener is formed by the lock back catch and the spring spacer.

* * * * *